United States Patent [19]

Terashima

[11] Patent Number: 4,952,981

[45] Date of Patent: Aug. 28, 1990

[54] TONER IMAGE PRINTING APPARATUS

[75] Inventor: Isamu Terashima, Hitachi, Japan

[73] Assignee: Hitachi, Ltd., Tokyo, Japan

[21] Appl. No.: 367,676

[22] Filed: Jun. 19, 1989

[30] Foreign Application Priority Data

Jun. 21, 1988 [JP] Japan ..... 63-151318

[51] Int. Cl.[5] ..... G03G 15/00

[52] U.S. Cl. ..... 355/309; 355/308

[58] Field of Search ..... 355/309, 308, 200, 210, 355/72, 64, 77, 133

[56] References Cited

U.S. PATENT DOCUMENTS

| | | | |
|---|---|---|---|
| 4,435,068 | 3/1984 | Landa | 355/309 |
| 4,580,890 | 4/1986 | Sugizaki et al. | 355/309 |
| 4,669,858 | 6/1987 | Ito et al. | 355/311 X |
| 4,718,658 | 1/1988 | Hirose et al. | 355/322 X |
| 4,733,310 | 3/1988 | Kapp et al. | 355/311 X |
| 4,739,369 | 4/1988 | Yoshiura et al. | 355/311 X |
| 4,819,029 | 4/1989 | Ito | 355/311 X |
| 4,857,963 | 8/1989 | Sutou | 355/323 X |
| 4,860,055 | 8/1989 | Ohira et al. | 355/308 |
| 4,866,487 | 9/1989 | Ohuchi et al. | 355/313 |

FOREIGN PATENT DOCUMENTS

| | | | |
|---|---|---|---|
| 61-188553 | 8/1986 | Japan | 355/309 |
| 63-186258 | 8/1988 | Japan | 355/309 |
| 64-81974 | 3/1989 | Japan | 355/309 |

*Primary Examiner*—R. L. Moses

*Attorney, Agent, or Firm*—Antonelli, Terry, Stout & Kraus

[57] ABSTRACT

A toner image printing apparatus has a first case accommodating a printing device for forming a toner image on a sheet, and a second case having a top wall for receiving the first case thereon and accommodating a sheet supplying device for supplying the printing device with a sheet on which the toner image is to be formed. The first case is provided in the center of the bottom wall thereof with a sheet inlet opening for receiving the sheet, while the second case is provided in the center of the top wall thereon with a sheet supplying opening through which the sheets are supplied by the sheet supplying device into the sheet inlet opening in the first case. The sheet inlet opening and the sheet supplying opening are maintained in alignment with each other even when the first case is rotated through 180° in a horizontal plane with respect to the second case.

18 Claims, 3 Drawing Sheets

TONER IMAGE PRINTING APPARATUS

BACKGROUND OF THE INVENTION

1. Field of the Invention:

The present invention relates to a toner image printing apparatus comprising a combination of a first case and a second case, the first case being provided with a printing mechanism for forming a toner image on a sheet-type recording medium, while the second case is adapted to receive on its top surface the first case and has a recording medium supply mechanism capable of supplying sheets of the recording medium to the printing mechanism in the first case.

In recent years, a remarkable progress has been achieved in the field of information processing systems represented by computers, and compact systems with high operation speeds have become available. Image reproducing apparatus, typically printers, connected to such systems also have been developed and, nowadays, electrophotographic apparatus such as laser beam printers are used widely.

In general, this type of image reproducing apparatus employs a primary recording medium on the surface of which an electrostatic latent image corresponding to the information to be printed is formed. The electrostatic latent image is then developed by a toner to form a toner image which is then transferred to a secondary recording medium. Usually, cut sheets are used as the secondary recording medium. The cut sheets are stored in a sheet cassette and extracted therefrom one by one so as to be fed to the printing apparatus. The sheet cassette is demountable from the apparatus in order to allow supply of cut sheets to the cassette. In order to minimize the size of the apparatus, in a common design of the apparatus, the sheet cassette is mounted on the apparatus in such a manner that the rear end portion of the sheet cassette projects outwardly from the body of the apparatus.

The cut sheets to which the toner image has been transferred and fixed are ejected from the apparatus body one after another, usually through an ejection opening formed in one side of the body of the apparatus, and are stacked on a tray provided adjacent to the ejecting opening. In some known apparatus, the cut sheets ejected through the ejection opening are conveyed to the upper side of the apparatus body so as to be stacked in a tray provided on the top of the apparatus body in a face-down state. i.e.. in such a manner that the printed image faces downward.

In the image reproducing apparatus of the kind described, as well as in ordinary toner image printing apparatus such as copying machines, the quantity of the information to be printed varies according to the conditions of use. Namely, it is necessary that a large quantity of sheets are supplied as required in order to cope with occasional demands for printing a great deal of information. To comply with such a requirement, a toner image printing apparatus has been proposed which has a combination of a first case provided with a printing mechanism for forming a toner image on a sheet and a second case adapted to receive on its top the first case and having a sheet supplying mechanism for supplying the printing mechanism with the sheets. This type of toner image printing apparatus has been disclosed, for example, in Japanese Patent Unexamined Publication Nos. 63-70269 and 60-122645.

The toner image printing apparatus of this type may be designed such that the opening for mounting a sheet cassette on the second case and the sheet ejection opening in the first case are provided on the same side of the apparatus. With such a design, it is difficult to find any space for mounting a sorter adjacent to the sheet ejection opening, because the rear portion of the sheet cassette projects from the apparatus under of the ejection opening. On the other hand, when the design is such that the sheets are ejected and stacked in face-down state on the top of the apparatus, an inconvenience is caused that the sheet cassette is accessible for demounting only in the direction which is opposite to the direction in which printed sheets are accessed.

SUMMARY OF THE INVENTION

Accordingly, an object of the present invention is to provide a toner image printing apparatus which is improved to eliminate any inconvenience encountered with the handling of the sheet cassette and the printed sheets, thereby overcoming the above-described problems of the prior art.

To this end, according to the present invention, there is provided a toner image printing apparatus comprising, in combination, a first case accommodating a printing device for forming a toner image on a sheet-type recording medium, and a second case having a top surface for receiving on its top the first case and accommodating a recording medium supplying device for supplying the printing device with the recording medium. The first case is provided with a recording medium ejection opening formed in a wall of the first case and for allowing a recording medium carrying fixed toner image to be ejected therethrough and a recording medium inlet opening formed in the bottom wall of the first case and capable of receiving a recording medium to which a toner image is to be fixed. The second case is provided with a recording medium receiving opening formed in one of the walls of the second case and adapted to receive the recording medium supplied from the outside of the second case and a recording medium supplying opening formed in the top wall of the second case and capable of supplying the recording medium from the recording medium receiving opening into the recording medium inlet opening in the first case. The recording medium inlet opening is formed in the center of the bottom wall of the first case, while the recording medium supplying opening is formed in the center of the top wall of the second case.

According to the invention, when the first case is placed on the second case such that the ejection opening in the first case for ejecting the recording medium after the recording and the receiving opening in the second case for receiving the recording medium are disposed on the same side of the assembled toner image printing apparatus, the recording medium inlet opening in the first case and the recording medium supplying opening in the second case are correctly aligned with each other, as well as when the first case has been placed such that the ejection opening and the receiving opening are disposed on the opposite sides of the assembled apparatus.

It is therefore possible to rotate the first case through 180° in a horizontal pane with respect to the second case, without impairing positional alignment between the recording medium supplying opening and the recording medium inlet opening:

This allows the direction of supply of the recording medium into the second case and the direction of ejection of the recording medium from the first case after the recording to be determined freely, thus enabling the toner image printing apparatus to adapt to a variety of condition of use.

The above and other objects, features and advantages of the present invention will become more clear from the following description of the preferred embodiments when the same is read in conjunction with the accompanying drawings.

DESCRIPTION OF THE PREFERRED EMBODIMENTS

Preferred embodiments of the present invention will be described with reference to the accompanying drawings.

Figure 1:
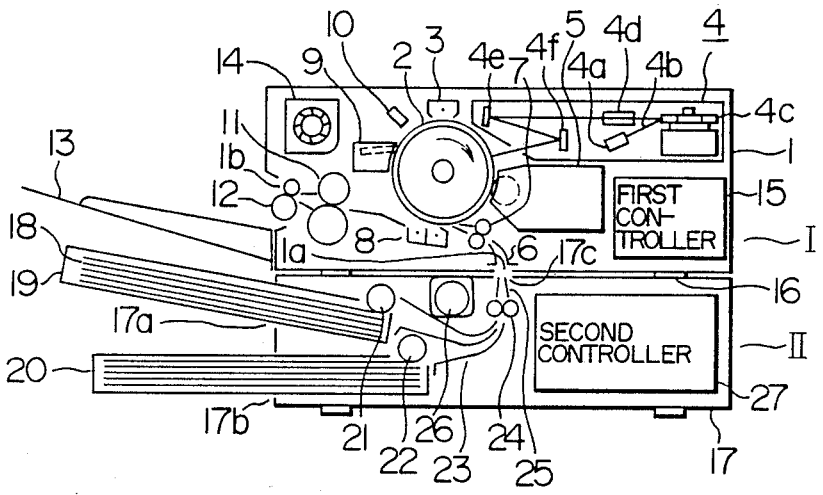
FIG. 1 is a vertical sectional view of a first embodiment of the toner image printing apparatus in accordance with t present invention.

Referring to FIG. 1, a first embodiment of the toner image printing apparatus of the present invention is mainly composed of two parts: namely, a printing section I which includes a printing device which performs an electrophotographic process to print, on a recording medium, a toner image of the information to be recorded and an ejecting device for ejecting the recording medium after the recording; and a recording medium supply section II which is capable of supplying the printing section I with the recording medium, the printing section I and the recording medium supply section II being coupled to each other such that the former I is placed on the latter II. In this embodiment, cut sheets of paper are conveniently used as the recording medium, so that a term "cut-sheet" is used here in to mean a cut-sheet-type recording medium.

Components and devices in the printing section I are generally encased by a first case 1. More specifically, the printing section has a photosensitive drum 2 the surface of which has been processed to exhibit photoconductivity. The photosensitive drum 2 is adapted to be rotated at a constant speed in the direction of an arrow. The printing section I also has a charger 3 which is capable of electrostatically charging the surface of the photosensitive drum 2 uniformly. The printing section I further has an exposure unit 4 which allows the uniformly charged surface of the photosensitive drum 2 to be exposed, thereby forming an electrostatic latent image on the surface of the photosensitive drum 2. In order to form the electrostatic latent image, the exposure unit 4 has a laser diode which is modulated in accordance with the image signal representing the information to be recorded, a rotary polygonal mirror for deflecting a laser beam **4*b* emitted from the laser diode 4*a* so as to enable the laser beam 4*b* to scan the surface of the photosensitive drum 2, an F-$\theta$ lens 4*d* and flat mirrors 4*e* and 4*f* which enable the optical axis to be adjusted. The printing section I further has a developing device 5 which develops the electrostatic latent image carried by the surface of the photosensitive drum 2 so as to form a visible toner image. A cut-sheet guiding mechanism 6 is capable of guiding the cut-sheets which have been introduced through a cut-sheet inlet opening 1*a* formed in the bottom wall of the first case 1 to a pair of resist rollers 7. The resist rollers 7 are capable of temporarily holding the leading end of the cut-sheet so as to locate the cut-sheet and feeds the same in synchronization with the surface speed of the photosensitive drum 2 so that the cut-sheet may be aligned with the toner image on the photosensitive drum 2. The cut-sheet fed by the regist rollers 7 is brought into contact with the surface of the photosensitive drum 2 and the portion of the cut sheet contacting with the photosensitive drum 2 is charged from its rear side, i.e., from the side opposite to the photosensitive drum 2, by a transfer charger 8, whereby the toner image on the photosensitive drum is transferred to the cut sheet. Toner particles remaining on the surface of the photosensitive drum after the transfer of the image are removed by a cleaner 9 and any residual electrostatic charges on the surface of the photosensitive drum 2 are removed by an erase lamp 10. A heat-roller tyPe fixing device 11 is capable of fixing the toner image on the cut-sheet, which is then ejected by an ejecting roller 12 onto an ejected sheet tray 13 through an ejection opening 1*b* formed on one side of the first case 1. The photosensitive drum 2, the developing device 5, the regist rollers 7, the heat-roller type fixing device 11 and the sheet ejecting roller 12 are driven by a motor 14. A controller 15 conducts various controls necessary for execution of the electrophotographic process. The first case 1 is placed on and coupled to the upper surface or the top of a later-mentioned second case 2 while being located by legs 16** and locating means provided on the lower surface of the bottom wall the first case, thereby to complete the toner image printing apparatus.

A description will be given of the sheet supplying section II. In this embodiment, the sheet feeding section II has the same shape and dimensions as the printing section I when viewed in plan. The sheet supplying section II has various parts generally encased by a second case 17. The second case 17 is provided in its one side with two sheet cassette mounting openings **17*a* and 17*b* which are spaced from and aligned with each other in the vertical direction. Sheet cassettes 19 and 20 each having a stack of cut-sheets are demountably mounted at their one ends in these sheet-cassette mounting openings 17*a* and 17*b*. The sheet-supplying section has sheet extracting rollers 21 and 22 which are associated with the sheet cassettes 19 and 20, respectively, so as to extract the cut-sheets 18 from the respective sheet cassettes 19 and 20 in a one-by-one fashion. Each of the sheet extracting rollers 21 and 22 drives the extracted cut-sheet 18 to sheet supplying rollers 24 via a sheet guide 23. The sheet supplying rollers 24 supply the cut-sheet 18 into the sheet inlet opening 1***a* formed in the bottom wall of the first case 1, via a sheet supply guide 25 and a sheet supplying opening 17*c* formed in the top wall of the second case 17. A motor 26 drives the extracting rollers 21 and 22 as well as the sheet supplying rollers 24. A second controller 27 is electrically connected to the first controller 15 so as to conduct an overall control of execution of the electrophotographic process as well as the supply of the cut-sheet in response to externally given instruction signals and image signals.

Figure 3:
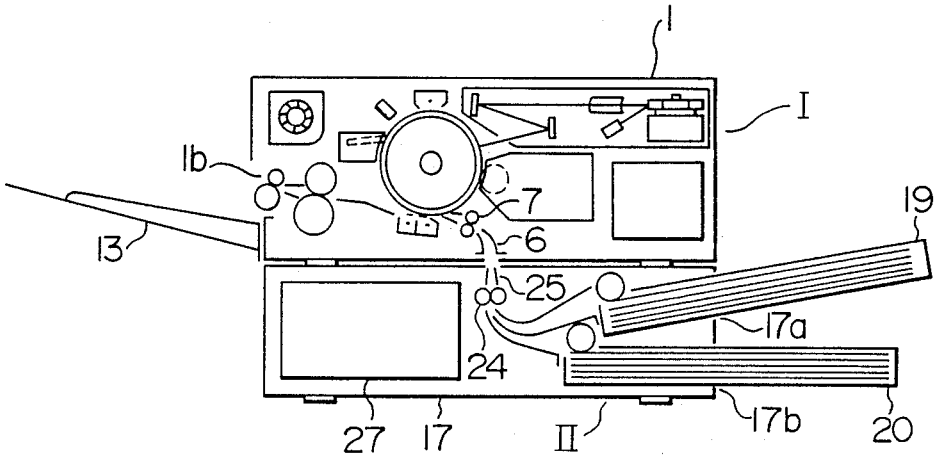
FIG. 3 is a vertical sectional view of the first embodiment, with the second case placed with respect to the first case in an orientation which is reverse to that in FIG. 1.

Referring to FIG. 3, the orientation of the sheet supplying section II with respect to the printing section I is reversed from that in the state shown in FIG. 1. Namely, the sheet supplying section II in the arrangement shown in FIG. 1 has been rotated in a horizontal plane through 180° from the position shown in FIG. 1.

Figure 2:
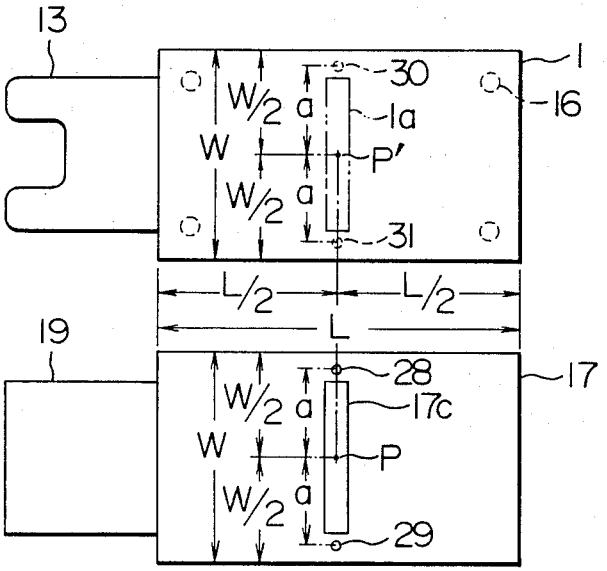
FIGS. 2 and 4 are schematic illustrations of a first case and a second case which form a printing section and a recording medium supply section of the first embodiment, showing in particular the positional relationship between a recording medium inlet opening and a recording medium supply opening as obtained when the first and the second cases are coupled in a stacked condition.
Figure 4:
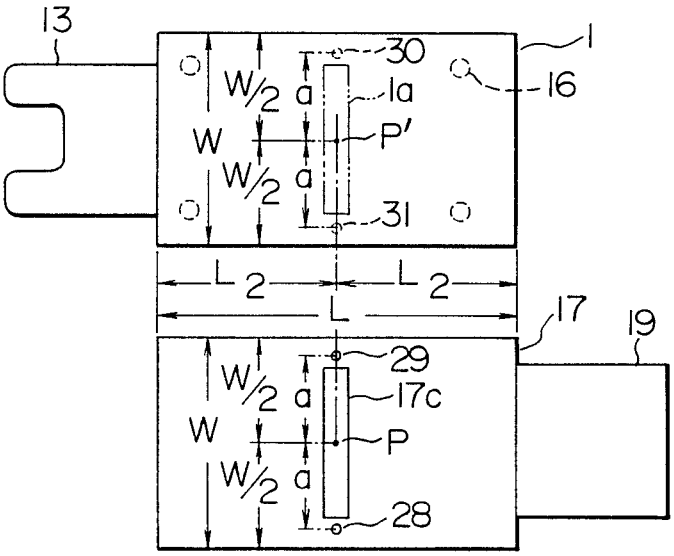

FIGS. 2 and 4 show that positional relationships between the sheet inlet opening 1*a* formed in the first case 1 and the sheet supplying opening 17*c* formed in the second case 17 when the first case 1 is mounted on and coupled to the second case 17 in the postures shown in FIGS. 1 and 3, respectively.

Referring to FIG. 2, the ejected sheet tray 13 on the first case 1 and the sheet cassettes 19 and 20 on the second case 17 are disposed on the same side of the toner image printing apparatus when the first case 1 is placed on the second case 17 in the posture shown in FIG. 1. The center P of the path of the cut-sheet 18 through the sheet supplying opening 17*c* formed in the top wall of the second case 17 is positioned at the mid point of the length L of the top surface of the second case 17, i.e., at a position which is at L/2 as measured from each longitudinal end of the second case 17 and also at the mid point of the width W of the top surface of the second case 17, i.e., at position which is W/2 as measured from each widthwise end of the top surface of the second case 17. Locating pins 28 and 29 are provided at both sides of the center P at an equal distance a as measured in the widthwise direction of the second case 17, at positions near respective ends of the sheet supplying opening 17*c*.

On the other hand, the center P′ of the path of the cut sheet 18 through the sheet inlet opening 1*a* formed in the bottom wall of the first case 1 is located at the mid point of the length L of the bottom surface of the first case 1, i.e., at a position which is at L/2 as measured from each longitudinal end of the first case 1 and also at the mid point of the width W of the bottom surface of the first case 1, i.e., at a position which is W/2 as measured from each widthwise end of the bottom surface of the first case 1. Locating pin receiving holes 30 and 31 are provided at both sides of the center P′ at an equal distance a as measured in the widthwise direction of the first case 1 and at positions near respective ends of the sheet inlet opening la. Both the sheet supplying opening 17*c* and the sheet inlet opening 1*a* are substantially rectangular slots which have substantially the same size and shape. The sheet supplying opening 17*c* is formed in the center of the top wall of the second case 17, while the sheet inlet opening 1*a* is formed in the center of the bottom wall of the first case 1. When the first case 1 is mounted on the second case 17, the first case 1 is precisely located by the cooperation between the locating pins 28 and 29 and the locating pin receiving holes 30 and 31 so that the sheet supplying opening 17*c* and the sheet inlet opening 1*a* are aligned with each other as will be seen from FIG. 1, thus enabling the cut sheet 18 delivered by the sheet supplying guide 25 to be smoothly introduced into the sheet guide 6 and to be registered by the regist rollers 7. The precision of the positional alignment between the sheet inlet opening 1*a* formed in the first case 1 and the sheet supplying opening 17*c* formed in the second case need not be so high and may be determined within a predetermined tolerance which would not impair smooth movement of the cut sheet 18 from the second case 17 into the first case 1 and which would not hamper the quality of the print.

Referring now to FIG. 3, the first case 1 and the second case 17 are coupled such that the ejected sheet tray 13 provided on the first case 1 and the sheet cassettes 19 and 20 provided on the second case 17 are disposed on both sides of the assembled toner image Printing apparatus, as will be seen also from FIG. 4. The first case 1 is located with respect to the second case 17 by the cooperation between the locating pins 28 and 29 and the locating pin receiving holes 30 and 31. Since the locating pins 28 and 29 and the locating pin receiving holes 30 and 31 are arranged in symmetry with respect to the centers P and P′ of paths of the cut sheet 18, the sheet supplying opening 17*c* in the second case 17 and the sheet inlet opening 1*a* in the first case 1 are aligned with each other, thus enabling the cut sheet 18 delivered by the sheet supplying guide 25 to be smoothly introduced into the sheet guide 6 and to be received by the regist rollers 7.

In this case, since the ejection opening 1*b* is disposed on the opposite side of the apparatus to the sheet cassettes 19 and 20, it is possible to demount the ejected sheet tray 13 and to place a sorter in place of the tray 13.

In the described embodiment, the bottom surface of the first case 1 and the top surface of the second case 17 have the same size and shape so that the first case 1 and the second case 17 can be stacked such that the side surfaces of both cases are flush with each other, thus providing a neat or an attractive appearance. In this embodiment, it is preferred that the sheet inlet opening la and the sheet supplying opening 17*c* are formed at the longitudinal and widthwise centers of the bottom surface of the first case and the top surface of the second case 17, so that the neat and attractive appearance of the toner image printing apparatus in the assembled state can be obtained regardless of the orientation of the first case 1 with respect to the second case 17.

Figure 5:
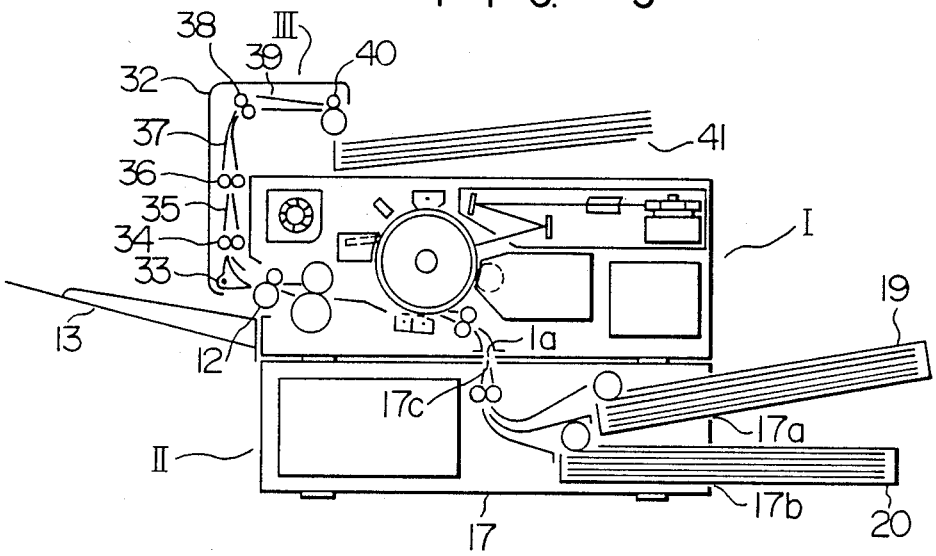
FIG. 5 is a vertical sectional view of a second embodiment of the toner image printing apparatus of the present invention, having a recording medium inverting section.

FIG. 5 shows a second embodiment of the toner image printing apparatus of the present invention in which a sheet inverting section III is provided on the printing section I so that the cut-sheets after the printing are ejected and stacked in face down state on the first case 1. The constructions of the printing section I and the sheet supplying section II of this embodiment are essentially the same as those of the first embodiment described in connection with FIG. 1 and, therefore, detailed description of these sections I and II is omitted. Thus, the following description of the second embodiment will be focused on features which are not employed in the first embodiment.

The sheet inverting section III has a third case 32 having a sheet passage switching guide 33, sheet conveyor rollers 34, a sheet guide 35, sheet conveyor rollers 36, a sheet guide 37, sheet conveyor rollers 38, a sheet guide 39 and sheet ejecting rollers 40. The sheet passage change-over guide 33 has a function to selectively direct the cut sheet 18 from the sheet ejecting rollers 12 either to the ejected sheet tray 19 or to the sheet conveyor rollers 34. In FIG. 5, the sheet passage change-over guide 33 is shown to be set so as to direct the ejected sheet 18 towards the sheet conveyor rollers 34. In this case, the cut sheets after the printing, ejected by the sheet ejecting rollers 12, are successively conveyed through the sheet conveyor rollers 34, the sheet guide 35, the sheet conveyor rollers 36, the sheet guide 37, the sheet conveyor rollers 38, the sheet guide 39 and the sheet ejecting rollers 40 so as to be ejected and stacked in face-down state on a face-down sheet tray 41 which is provided on the top of the first case 1.

Figure 6:
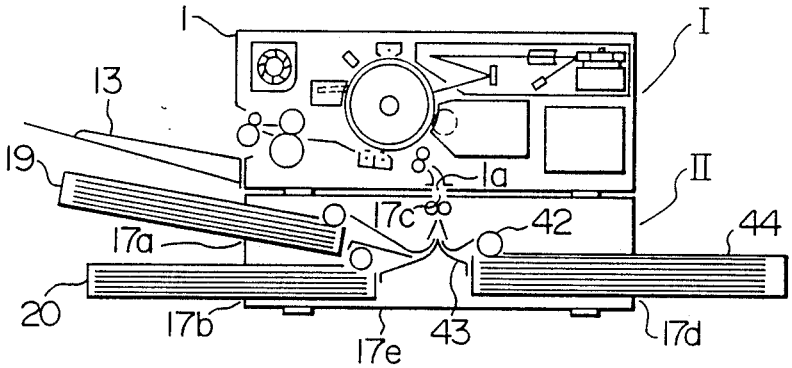
FIGS. 6 and 7 are vertical sectional views of a third embodiment which has three recording medium cassettes.
Figure 7:
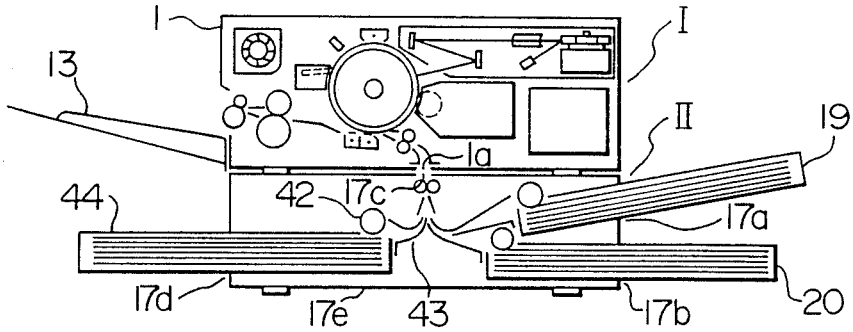

FIGS. 6 and 7 shows a third embodiment of the Present invention which is designed to enable three sheet cassettes to be mounted simultaneously. This toner image Printing apparatus is suitable for performing an efficient printing of images on cut sheets of various sizes. The printing section I in this embodiment has the same construction as that in the first embodiment and, hence, is devoid of the sheet inverting section used in the second embodiment. It is to be understood, however, that this embodiment may be modified to include a sheet inverting section similar to that used in the second embodiment.

The second case 17*e* of the third embodiment is provided with a sheet cassette mounting opening 17*d* for mounting a third sheet cassette 44, formed in the end wall of the second case 17 opposite to the end wall in which the aforementioned sheet cassette mounting openings 17*a* and 17*b* are formed. The sheet supplying section II of this embodiment further has an extracting roller 42 and a sheet guide 43 which are associated with the third sheet cassette 40.

FIG. 6 shows the third embodiment in a state in which the first case 1 and the second case 17 are assembled such that the sheet cassettes 19 and 20 are Provided on the same side of the apparatus as the ejected sheet tray 13, whereas, in FIG. 7, the first and second cases 1 and 17 are assembled such that the third sheet cassette 44 appears on the same side as the ejected sheet tray 13. Whether two cases 1 and 17 are assembled in the state shown in FIG. 6 or in the state shown in FIG. 7 is determined in accordance with various conditions such as the sizes of the cut sheets stacked in the sheet cassettes, the size of the information to be printed and the quantity of the prints to be obtained.

Although combination of locating pins 28 and 29 and the locating pin receiving holes 30 are 31 are specifically utilized as the locating means for locating the printing section I and the sheet supplying section II with respect to each other, it will be apparent to those skilled in the art that various other locating means may be used equally well. For instance, it is possible to use suitable connecting members which are capable of connecting the first case 1 and the second case 17 while precisely locating these cases 1 and 17 with respect to each other.

It is also to be understood that, although a printer for an information processing system such as a computer has been specifically described, the toner image printing apparatus of the present invention can be embodied in various other forms such as ordinary copying machines and so forth.

What is claimed is:

1. A toner image printing apparatus comprising, in combination, a first case accommodating a printing device for forming a toner image on a sheet-type recording medium, and a second case having a top for receiving thereon said first case and accommodating a recording medium supplying device for supplying said printing device with said recording medium;

said first case being provided with a recording medium ejection opening formed in a wall of said first case to allow a recording medium carrying fixed toner image to be ejected therethrough, and a recording medium inlet opening formed in the bottom wall of said first case and capable of receiving a recording medium to which a toner image is to be fixed;

said second case being provided with a recording medium receiving opening formed in one of the walls of said second case and adapted to receive said recording medium supplied from the outside of said second case and a recording medium supplying opening formed in the top wall of said second case and capable of supplying said recording medium from said recording medium receiving opening into said recording medium inlet opening in said first case;

said recording medium inlet opening being formed in substantially the center of said bottom wall of said first case, while said recording medium supplying opening is formed in substantially the renter of said top wall of said second case.

2. A toner image printing apparatus according to claim 1, wherein said recording medium receiving opening is a cassette mounting opening for detachably mounting therein a cassette accommodating a stack of said recording medium.

3. A toner image printing apparatus according to claim 2, wherein said cassette mounting opening is designed to allow said recording medium cassette to be inserted such that the trailing end of said cassette, as viewed in the direction of supply of said recording medium, remains outside said second case.

4. A toner image printing apparatus according to claim 1, wherein at least one said cassette mounting opening is formed in one of side walls of said second case.

5. A toner image printing apparatus according to claim 1, further comprising at least one additional cassette mounting opening formed in another side wall of said second case, said another side wall being disposed in opposed relationship to said one side wall.

6. A toner image printing apparatus according to claim 1, wherein said recording medium ejection opening is formed in one of side walls of said first case, and said recording medium receiving opening is formed in said one of said side walls of said second case.

7. A toner image printing apparatus according to claim 1, further comprising a third case secured to said first case, said third case having a recording medium inverting means for turning upside down the recording medium ejected through said recording medium ejection opening.

8. A toner image printing apparatus according to claim 1, wherein said recording medium supplying device is arranged to supply said recording medium vertically upwardly through said recording medium supplying opening.

9. A toner image printing apparatus according to claim 1, further comprising locating means provided on said first and second cases and capable of locating said first case with respect to said top of said second case.

10. A toner image printing apparatus comprising, in combination, a first case accommodating a printing device for forming a toner image on a sheet, and a second case having a top for receiving thereon said first case and accommodating a sheet supplying device for supplying said printing device with said sheet;

said first case being provided with a recording medium ejection opening formed in one of side walls of said first case and for allowing said sheet carrying fixed toner image to be ejected therethrough, and a sheet inlet opening formed in the bottom wall of said first case and capable of receiving a sheet to which a toner image is to be fixed;

said second case being provided with a sheet receiving opening formed in one of said walls of said second case and adapted to receive said sheet supplied from the outside of said second case; and a sheet supplying opening formed in the top wall of said second case and capable of supplying said sheet from said sheet receiving opening into said sheet inlet opening in said first case;

said sheet inlet opening and said sheet supplying opening being located with respect to said first case and said second case, respectively, such that the center of the path of said sheet through said sheet inlet opening and the center of the path of said sheet through said sheet supplying opening are aligned with each other even when said first case is rotated 180° in a horizontal plane with respect to said second case.

11. A toner image printing apparatus comprising, in combination:

a first case accommodating a toner image forming means for forming a toner image on a primary recording medium, a transfer means for transferring said toner image from said primary recording medium to a sheet-type secondary recording medium, and fixing means for fixing the transferred toner image to said secondary recording medium, said first case having a secondary recording medium inlet opening formed in the center of the bottom wall thereof and capable of allowing said secondary recording medium to be introduced therethrough into said first case, and an ejection opening for allowing said secondary recording medium after the fixing of said toner image to be ejected outside said second case; and a second case having a top wall for receiving said first case thereon and accommodating secondary recording medium supplying means, said second case having a cassette mounting opening for mounting therein a cassette carrying a stack of said secondary recording medium, and a secondary recording medium supplying opening which is formed in the center of said top wall and through which said secondary recording medium extracted from said cassette is supplied by said secondary recording medium supplying means into said secondary recording medium inlet opening.

12. A toner image printing apparatus according to claim 11, wherein said cassette mounting opening is formed in one of the side walls of said second case, and wherein said second case is so constructed as to enable said cassette to be inserted therein with the trailing end of said cassette as viewed in the direction of supply of said secondary recording medium remaining outside said second case.

13. A toner image printing apparatus according to claim 11, wherein said recording medium ejection opening is formed in one of the side walls of said first case and said cassette mounting opening is formed in the corresponding one of the side surfaces of said second case.

14. A toner image printing apparatus according to claim 11, wherein said secondary recording medium supplying means is capable of supplying said secondary recording medium vertically upwardly through said secondary recording medium supplying opening.

15. A toner image printing apparatus according to claim 11, wherein said second case has a plurality of said cassette mounting openings formed in said one of said side walls thereon.

16. A toner image printing apparatus according to claim 11, further comprising locating means for locating said first case with respect to the top surface of said second case, said locating means including locating pins provided on one of said first and second cases and locating pin receiving holes formed in the other of said first and second cases.

17. A toner image printing apparatus comprising, in combination:

a first case accommodating a toner image forming means for forming a toner image on a primary recording medium, a transfer means for transferring said toner image from said primary recording medium to sheet-type secondary recording medium, and fixing means for fixing the transferred toner image to said secondary recording medium, said first case having a secondary recording medium inlet opening formed in the bottom wall thereof and capable of allowing said secondary recording medium to be introduced therethrough into said first case, and an ejection opening for allowing said secondary recording medium after the fixing of said toner image to be ejected outside said second case; and a second case having a top wall for receiving said first case thereon and accommodating secondary recording medium supplying means, said second case having a cassette mounting opening for mounting therein a cassette carrying a stack of said secondary recording medium, and a secondary recording medium supplying opening which is formed in said top wall and through which said secondary recording medium extracted from said cassette is supplied by said secondary recording medium supplying means into said secondary recording medium inlet opening;

wherein said sheet inlet opening and said sheet supplying opening are located with respect to said first case and said second case, respectively, such that the center of the path of said secondary recording medium through said sheet inlet opening and the center of the path of said secondary recording medium through said sheet supplying opening are aligned with each other even after a 180° rotation of said first case in a horizontal plane with respect to said second case.

18. A toner image printing apparatus according to claim 17, further including locating means for locating said first case with respect to the top surface of said second case, said locating means including locating pins provided on one of said first and second cases and locating pin receiving holes formed in the other of said first and second cases.

* * * * *